US005302792A

United States Patent [19]

No et al.

[11] Patent Number: 5,302,792

[45] Date of Patent: Apr. 12, 1994

[54] HIGH FREQUENCY COOKING DEVICE WITH TURNTABLE AND WEIGHT SENSOR

[75] Inventors: Hwa-Gyu No; Jong-Hak Hyun, both of Seoul, Rep. of Korea

[73] Assignee: Samsung Electronics Co., Ltd., Suwon, Rep. of Korea

[21] Appl. No.: 50,638

[22] Filed: Apr. 22, 1993

[30] Foreign Application Priority Data

May 18, 1992 [KR] Rep. of Korea ..... 92-8458
May 18, 1992 [KR] Rep. of Korea ..... 92-8459

[51] Int. Cl.[5] ..... H05B 6/78

[52] U.S. Cl. ..... 219/754; 219/518; 219/708

[58] Field of Search ..... 219/10.55 F, 10.55 E, 219/10.55 B, 518

[56] References Cited

U.S. PATENT DOCUMENTS 4,225,767 9/1980 Hatanaka et al. ..... 219/10.55 F
4,591,682 5/1986 Takeuji ..... 219/10.55 F
4,631,379 12/1986 Aoyama ..... 219/10.55 F
4,673,800 6/1987 Hirai et al. ..... 219/518
4,703,151 10/1987 Sakamoto ..... 219/10.55 B
4,831,239 5/1989 Ueda ..... 219/10.55 B
4,895,067 1/1990 Ohji et al. ..... 219/10.55 B
5,166,486 11/1992 Komatsu ..... 219/10.55 F

FOREIGN PATENT DOCUMENTS 63-3435 1/1988 Japan .

*Primary Examiner*—Philip H. Leung
*Attorney, Agent, or Firm*—Burns, Doane, Swecker & Mathis

[57] ABSTRACT

A high frequency heating device designed to swiftly and accurately detect a to-be-cooked food placed on a turn table within a cooking chamber to thereby set up a cooking time or a driving time of a magnetron in accordance with a weight of the food, so that an appropriate cooking can be performed. A weight sensor on a lower bottom surface of the cooking chamber in order to detect the weight of the to-be-cooked food located on a turntable during a rotation of the turntable.

4 Claims, 4 Drawing Sheets

HIGH FREQUENCY COOKING DEVICE WITH TURNTABLE AND WEIGHT SENSOR

BACKGROUND OF THE INVENTION

1. Field of the Invention

The present invention relates to a high frequency heating device or so-called microwave oven for performing a cooking by heating food in a high frequency.

2. Description of the Prior Art

Typical of such a heating device cooking by means of a high frequency is the one disclosed in Japanese patent application No. Sho 63-3435 as illustrated in FIG. 1.

The high frequency heating device as disclosed in the application is formed with a cooking chamber 11, one end of which being mounted with a magnetron 13 for emitting a high frequency which is induced into the cooking chamber 11 through a conduit 12 to thereby heat food 14 while on a lower end of the cooking chamber 11 there is provided a turntable 15 turning in response to a driving of a driving motor 17. On a lower end of the turntable 15 there is provided a roller 16 which supports the turntable 15 and simultaneously rotates according to a predetermined track. In the high frequency heating device thus constructed when the food 14 is placed on the turntable 15, the turn table is rotated in accordance with an operation of the driving motor 17 and the roller 16 mounted on the lower end of the turntable 15 is rotated supporting the turntable 15. In the high frequency heating device thus constructed however, because a weight of the food 14 placed on the turn table 15 can not be detected and a time for cooking can not be accurately determined, the food 14 can not be adequately cooked, and depending on circumstances, the cooking may not be complete, resulting in the need for re-cooking and increased consumption of electricity.

SUMMARY OF THE INVENTION

Accordingly, the present invention is disclosed to solve the aforesaid conventional problems and it is therefore an object of the present invention to provide a high frequency heating device which can accurately weigh and quickly detect a to-be-cooked food placed on a turntable to thereby set up a cooking time appropriate to a food weight so that cooking can be done easily.

In order to achieve the above object, the high frequency heating device according to the present invention comprises a cooking chamber for cooking food a turntable mounted on a lower area of the cooking chamber on which a to-be-cooked food is placed, rollers rotatably mounted so that the turntable can be smoothly rotated a bracket for fixing the roller to a floor surface of the cooking chamber; a driving motor fixed to a lower area of the floor surface of the turntable so that the turntable can be rotated; and a weight sensor which senses a food weight on the turntable by being interposed on the lower area of the bottom surface of the turntable through a supporting frame when a rotating power of the driving motor is received to thereby rotate the turntable.

BRIEF DESCRIPTION OF THE DRAWINGS

Other objects and aspects of the invention will become apparent from the following description of embodiments with reference to the accompanying drawings in which:

FIG. 3 is a cross-sectional view for illustrating an assembled state of the embodiment of FIG. 2*a.

DETAILED DESCRIPTION OF THE PREFERRED EMBODIMENTS

Hereinafter, preferred embodiments of the present invention will be described in detail with reference to the accompanying drawings.

Figure 1:
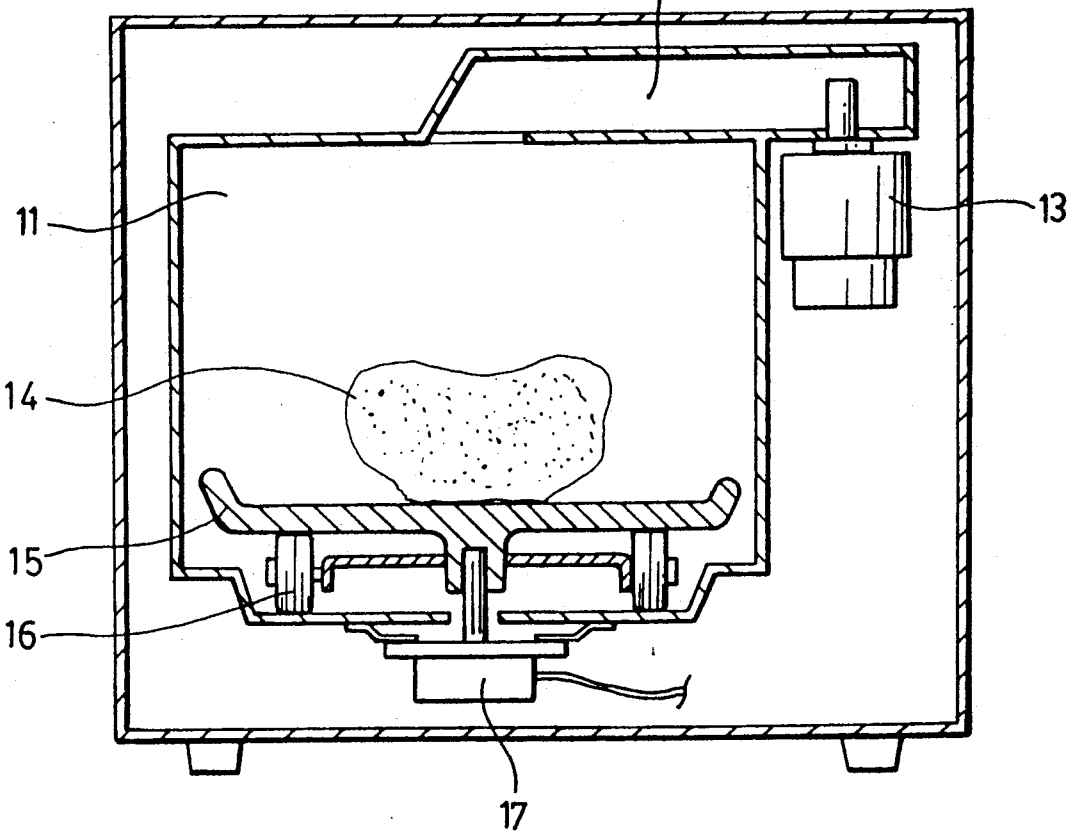
FIG. 1 PRIOR ART
FIG. 1 is a cross-sectional view for schematically illustrating a conventional high frequency heating device
Figure 2A:
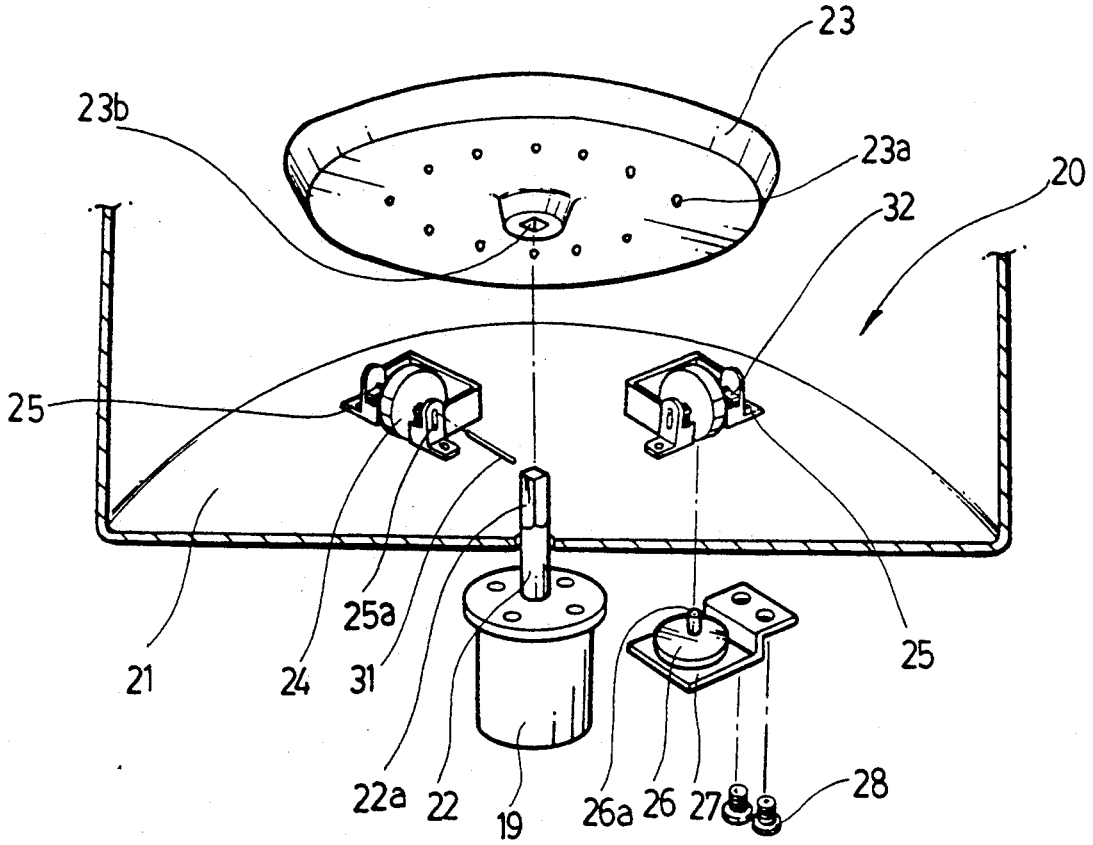
FIG. 2*a* is an exploded sectional side elevation view for illustrating a portion of the high frequency heating device in accordance with one embodiment of the present invention.
Figure 2B:
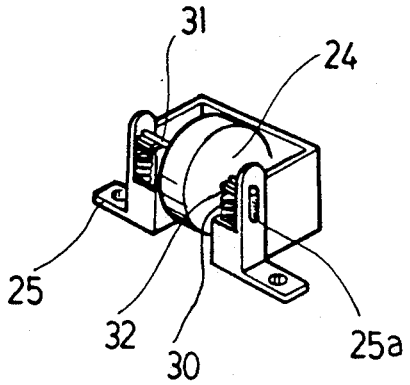
FIG. 2*b* is a perspective view of a bracket and a roller employed in the embodiment of the present invention depicted in FIG. 2*a;*
Figure 3:
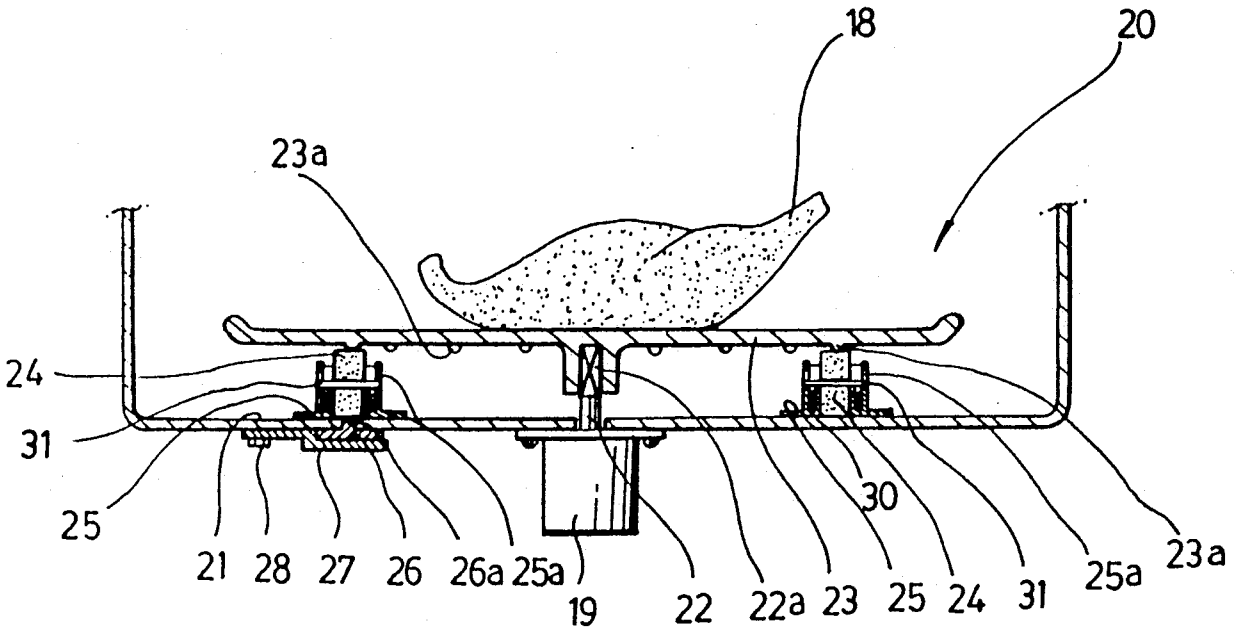

In a high frequency heating device as illustrated in FIGS. 2*a*, 2*b* and 3, a driving motor 19 is bolted to a lower area of a floor surface 21 of a cooking chamber 20 and a rotating axis 22*a* of the driving motor 19 is extended to an inside of the cooking chamber 20 through a hole formed on the floor surface 21.

A top end of the rotating axis 22*a* is formed with a multi-angled shape, for example, a triangular or rectangular shape in order to be fitted into a slotted hole 23*b* formed in a center portion of the bottom area of the turntable and to thereby rotate the turn table 23 according to the rotation of the driving motor 19.

Furthermore, on the bottom area of the turntable 23 on which the to-be-cooked food is placed, there are provided a multitude of lugs 23*a* spaced out in an even distance along a circular travelling track of the roller in order to contact a surface of the roller (to be mentioned later) when the turn table is rotated.

On a lower area facing the multitudes of the lugs 23*a*, there are provided more than two rollers 24 interposed through an axis 31 for rotatability, so that the same can be rotatably mounted to a bracket 25 fixed on a floor surface 21.

To put the above in more detail, the roller 24, as illustrated in FIG. 2*b*, is rotatably mounted in an oblong hole 25*a* formed in the bracket 25 through the axis 31, and a coil spring 30 is inserted into a groove formed adjacent the lower end portion of the oblong hole 25*a* in order to support the axis resiliently.

A spring seat 32 is mounted on the upper end portion of the spring coil 30 in order to support the axis 31, so that the axis 31 is supported to the spring seat 32 resiliently.

Meanwhile, a weight sensor 26 positioned on a lower area of the floor surface 21 with which the lower surface of the roller 24 cones into contact in order to detect a weight of food 18 to be cooked is fixedly mounted within a supporting frame 27. Detecting lug 26*a* of the weight sensor 26 is protruded toward the cooking chamber 20 through a piercing hole formed on the floor surface 21, so that the detecting lug 26*a* can contact a lower periphery of the roller 24.

Accordingly, when the food to be cooked 18 is placed on the turntable 23, the multitudes of lugs 23*a* protrudingly formed on a floor surface of the turntable 23 rotating according to an operation of the driving motor 19 come in touch with the lower periphery of the roller 24 and at the same time, the detecting lug 26*a* of the weight sensor 26 is pressed by the lower periphery of the roller 24, so that the weight of the food to be cooked is swiftly and accurately detected.

In the foregoing descriptions, the supporting frame 17 supporting the weight sensor 26 is fastened to a lower area of the floor surface 21 and the like by fastening means.

Next, an operation of the preferred embodiment of the high frequency heating device thus constructed will be described.

First of all, when the food 18 to be cooked is placed on the turntable in the cooking chamber 20 and the high frequency heating device is activated, the driving motor 19 begins to rotate.

At this moment, the turntable is rotated and simultaneously, the rollers 24 are rotated, so that the lugs 23 formed protrudingly on the floor surface of the turntable 23 can contact the upper periphery of the rollers 24.

Accordingly, the roller 24 associated with the weight sensor 26 is pressed downward by the lugs 23*a*, and a rotating center axis 31 of the roller 24 presses the spring seat 32 in opposition to a loaded power of the coil spring 30, so that the rotating center axis is pushed downward along the oblong hole 25*a*.

At this moment, because the lower side of the periphery in the roller 24 presses the detecting lug 26*a* of the weight sensor 26, the weight of the food 18 to be cooked is accurately detected.

Meanwhile, because the lugs 23*a* protrudingly formed on the floor surface of the turntable 23 are formed in multitudes over a position facing a rotating track along which the roller 24 travels, the weight of the food 18 to be cooked is transmitted to the weight sensor 26 through the lugs 23*a* and the roller 24 whenever the lugs 23 contact the upper side periphery of the roller during a rotation of the turntable 23, so that the weight of the food 18 is accurately and quickly detected.

Furthermore, the weight of the food 18 to be cooked is detected by the weight sensor 26 to the extent of respective numbers of the lugs 23*a* to thereafter be inputted to a computer (not shown), so that the microcomputer performs an operation on an arithmetic mean of respectively-detected weights of the food, making it possible to drastically reduce an initial correctional time.

Accordingly, because a cooking time or an operating time of the magnetron against the weight of the food 18 to be cooked can be set up in accordance with a determination of the microcomputer, the cooking time of the food 18 can be quickly and accurately established.

In the aforesaid description, although the invention has been described in detail with reference to an example having only one weight sensor 26 contacting the lower side periphery of a roller disposed on the lower area of the floor surface 21, it should be apparent that the present invention is not limited to one weight sensor, and for example, an installation of a plurality of weight sensors 26 can be included in the concept of the present invention.

Next, another embodiment of the present invention will be described with reference to FIG. 4.

Figure 4:
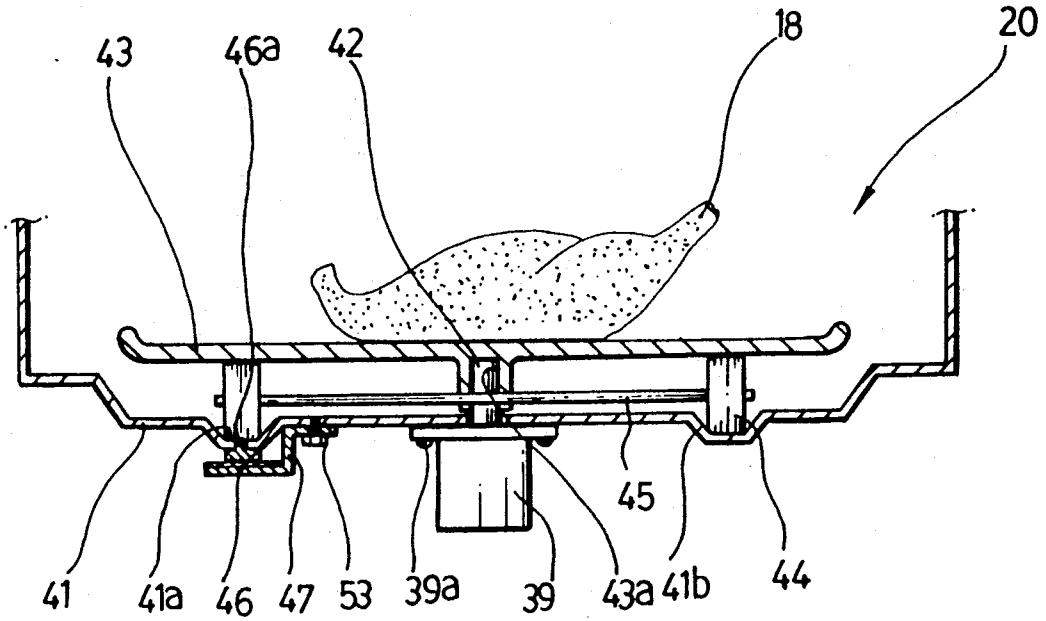
* and FIG. 4 is a fragmentary cross-sectional view of a high frequency heating device in accordance with another embodiment of the present invention.

FIG. 4 is a partial cross-sectional view of a high frequency heating device in accordance with another embodiment of the present invention, wherein a driving motor 39 is fixed by a fastening bolt on an approximate lower center area of a bottom floor in a cooking chamber 20 and a circular rotary axis 42 of the driving motor 39 is extended to the cooking chamber 20 through a piercing hole formed on the bottom floor of the cooking chamber 20. The circular rotary axis 42 is inserted in a slotted groove 43*a* formed on the central area of the lower bottom of a turntable 43 on which a to-be-cooked food is to be placed.

Furthermore, on both ends of a supporting axis 45 inserted through holes (not shown) formed respectively on the slotted groove 43*a* and the circular rotary axis 42, there are provided rollers 44 in order to smooth-out a rotation of the turntable 43 by receiving a driving power in accordance with the driving motor 39 through the circular rotary axis 42 and supporting axis 45. In order to facilitate a rotary driving of the turntable 43 in a ringshaped concave area 41*a* is formed on the bottom floor 41 the cooking chamber 20, so that the rollers 44 can be rotatably supported therein.

On the lower surface of the concave area 41*a* formed on the bottom floor 41, there is provided a weight sensor 46 for detecting a weight of the food 18. The sensor 46 is supported by a supporting frame 47, and a detecting lug 46*a* of the sensor 46 is in contact with a periphery of the rollers 44 which are driven in response to a rotation of the turntable 43. The lug 46*a* projects into the cooking chamber 20 through a piercing hole formed in the concave area 41*a*, so that the weight of the food 18 to be cooked can be detected.

The supporting frame 47 is fixed to lower surface of the bottom floor 41 by a fastening bolt 53.

In the foregoing construction, the ringshaped concave area 41*a* is advisably formed on the bottom floor 41 which is on the same position as the rotating travelling track of the rollers 44 disposed on respective ends of the supporting axis 45, and on both sides of the concave area 41*a* there are provided slopes 41*b*, so that the roller 44 can smoothly be rotated.

In the high frequency heating device thus constructed in accordance with the present invention, when the food 18 to be cooked is placed on the turntable 43 and the high frequency heating device is activated, the turntable 43 is rotated in accordance with an activation of the driving motor 39 and simultaneously the rollers 44 mounted on the lower side thereof are also rotated alongside the concave area 41*a* formed on the bottom floor 41 within the cooking chamber 20.

At this moment, the peripheries of the rollers 44 successively press the protruding lug 46*a* of the weight sensor 46 to thereby detect swiftly and accurately the weight of the food 18 to be cooked, so that the weight data therefrom is inputted to a microcomputer (not shown). The microcomputer sets up and controls a cooking time and driving time of the magnetron in response to the weight of the food 18 to be cooked to thereby cook the food 18.

As described in the aforesaid, in the present invention in accordance with the high frequency heating device, because a weight sensor is set up so as to detect a weight of the food on the turntable placed along the travelling track which the rollers pass by, so that the weight of the food can be accurately and swiftly detected during the rotation of the turntable, the cooking time and driving time of the magnetron can be established in accordance with the weight of the food to be cooked to thereby achieve a marked effect of a reduced electric consumption.

Although, the present invention has been described with reference to the specified embodiment, it would be apparent to those skilled in the art that various changes and modifications may be made therein without departing from the spirit and scope of the invention.

What is claimed is:

1. A high frequency cooking device comprising:

a housing forming a cooking chamber for cooking food, said chamber including a floor;

a food-supporting turntable mounted in said chamber for rotation about a vertical axis, said turntable including a plurality of downwardly depending first lugs disposed on an underside thereof and arranged in an annular pattern about said vertical axis;

driving means for rotating said turntable about said vertical axis;

means for supplying a high frequency waves to said chamber for cooking food supported on said turntable;

support rollers mounted on a topside of said floor and disposed in fixed locations in said chamber beneath said turntable, each of said support rollers being freely rotatable about a horizontal axis within a respective bracket affixed to said floor;

one of said support rollers being mounted for vertical movement within its bracket and biased upwardly, said one support roller being spaced radially from said vertical axis and positioned to be contacted sequentially by said first lugs as said turntable rotates; and a weight sensor device affixed to an underside of said floor and including a second lug projecting upwardly into said chamber through a hole in said floor, and engaging said one support roller so that said one support roller bears downwardly against said second lug while supporting said turntable to enable said weight sensor to weigh food disposed on said turntable.

2. The high frequency cooking device according to claim 1, wherein said one roller is mounted on an axle, opposite ends of said axle being mounted in respective vertical slots formed in said bracket to which said one roller is mounted, said axle being vertically movable in said slots.

3. The high frequency cooking device according to claim 1 further including at least one spring biasing said one support roller upwardly.

4. The high frequency cooking device according to claim 1, wherein said driving means comprises a motor affixed to said underside of said floor, and a vertical drive shaft projecting through said floor and operable connected to said motor and turntable for transmitting rotation from said motor to said drive shaft, said drive shaft defining said vertical axis.

* * * * *